US010132287B2

(12) United States Patent
Hattori et al.

(10) Patent No.: US 10,132,287 B2
(45) Date of Patent: Nov. 20, 2018

(54) IGNITION CONTROL SYSTEM

(71) Applicant: DENSO CORPORATION, Kariya, Aichi-pref. (JP)

(72) Inventors: Kenji Hattori, Kariya (JP); Ippei Funato, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/830,441

(22) Filed: Dec. 4, 2017

(65) Prior Publication Data

US 2018/0156182 A1 Jun. 7, 2018

(30) Foreign Application Priority Data

Dec. 5, 2016 (JP) ..... 2016-236146

(51) Int. Cl.

| | |
|---|---|
| ***F02P 15/08*** | (2006.01) |
| ***F02P 5/15*** | (2006.01) |
| ***F02D 41/14*** | (2006.01) |
| ***F02P 3/05*** | (2006.01) |
| *F02D 41/00* | (2006.01) |

(52) U.S. Cl.

CPC ..... *F02P 15/08* (2013.01); *F02D 41/1454* (2013.01); *F02P 3/05* (2013.01); *F02P 5/1516* (2013.01); *F02D 41/0072* (2013.01)

(58) Field of Classification Search

CPC ..... F02D 37/02; F02D 41/14; F02D 41/1454; F02P 3/04; F02P 3/05; F02P 5/15; F02P 5/1516; F02P 15/08; F02P 17/00; F02P 17/10; F02P 17/12; F02P 23/00

USPC ..... 701/102, 105, 114, 115; 123/406.11, 123/406.12, 594, 597, 618–620, 622, 623, 123/627, 637, 644, 652, 655

See application file for complete search history.

(56) References Cited

U.S. PATENT DOCUMENTS

| | | | | |
|---|---|---|---|---|
| 5,333,593 A | | 8/1994 | Morganti et al. | |
| 5,422,811 A | * | 6/1995 | Togai | F02P 3/0456 123/406.29 |
| 5,476,084 A | | 12/1995 | Morganti et al. | |

(Continued)

FOREIGN PATENT DOCUMENTS

JP 2010-138880 6/2010

*Primary Examiner* — John Kwon
*Assistant Examiner* — Johnny H Hoang
(74) *Attorney, Agent, or Firm* — Nixon & Vanderhye PC

(57) ABSTRACT

In an ignition control system, a primary current control unit performs discharge generation control one or more times during a single combustion cycle. The discharge generation control allows a spark plug to generate a discharge spark. A parameter calculating unit successively calculates a parameter correlated with energy of a discharge spark. An energy density calculating unit successively calculates energy density that is energy per unit length of the discharge spark. When the energy density is greater than a predetermined value during a predetermined period after a primary current is interrupted during a single combustion cycle, an integrated value calculating unit calculates an integrated value by integrating the parameter during the predetermined period. The primary current control unit performs the discharge generation control again when the integrated value calculated by the integrated value calculating unit is less than a predetermined determination threshold.

18 Claims, 10 Drawing Sheets

(56) References Cited

U.S. PATENT DOCUMENTS

| | | | | |
|---|---|---|---|---|
| 6,020,742 | A * | 2/2000 | Kano | F02P 17/12 324/378 |
| 6,512,375 | B1 * | 1/2003 | Yamada | F02P 17/12 324/384 |
| 6,734,677 | B2 * | 5/2004 | Toriyama | G01N 27/62 324/380 |
| 7,121,270 | B1 * | 10/2006 | Plotnikov | F02P 15/10 123/604 |
| 2005/0066948 | A1 * | 3/2005 | Umino | F02P 3/0807 123/597 |
| 2005/0183697 | A1 * | 8/2005 | Yoshino | F02P 5/152 123/406.37 |
| 2007/0175461 | A1 | 8/2007 | Wada et al. | |
| 2012/0145136 | A1 * | 6/2012 | Burrows | F02P 9/007 123/608 |
| 2016/0084214 | A1 * | 3/2016 | Okuda | F02D 37/02 123/478 |

* cited by examiner

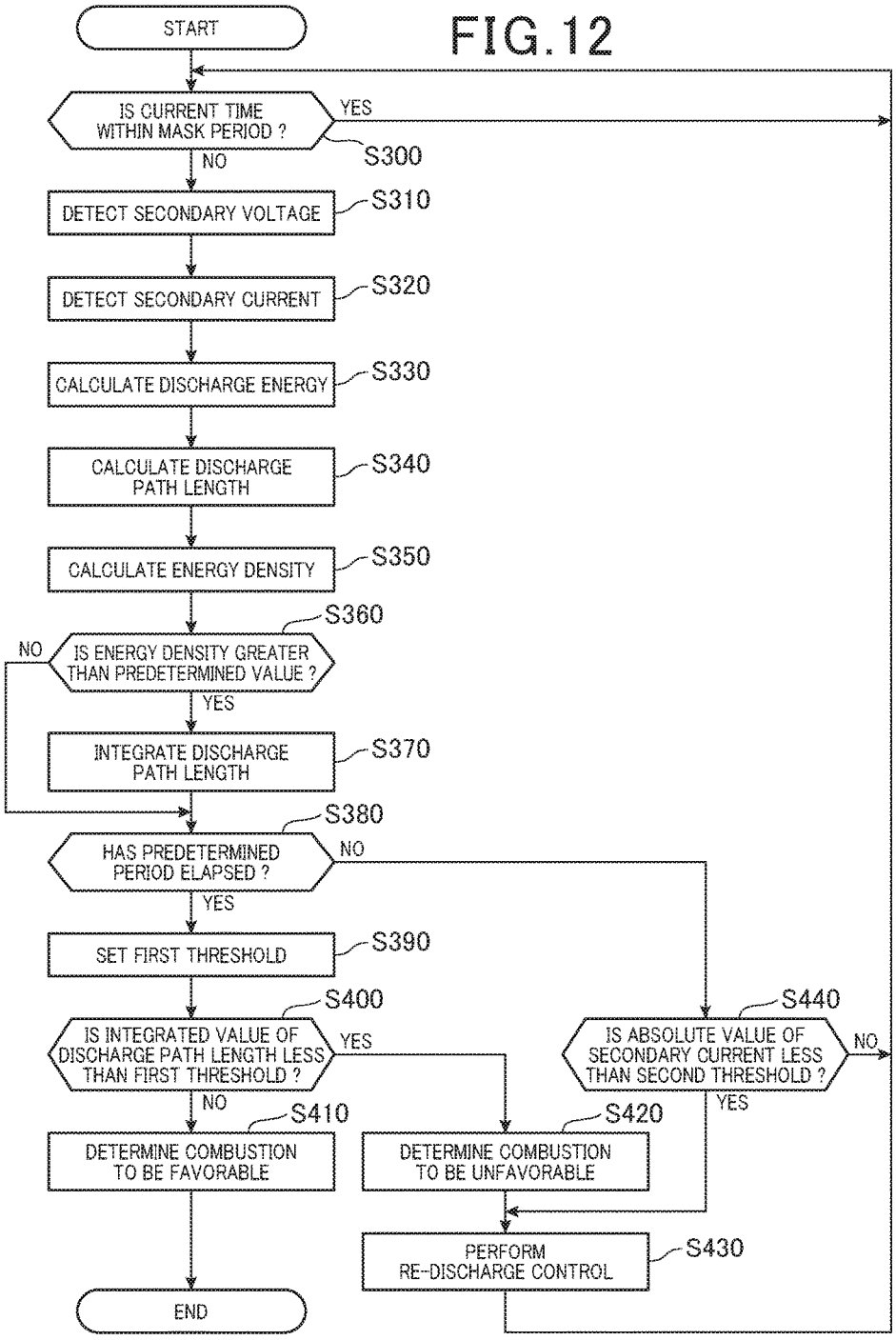
FIG.12
START
IS CURRENT TIME WITHIN MASK PERIOD ?
YES
NO
S300
DETECT SECONDARY VOLTAGE
S310
DETECT SECONDARY CURRENT
S320
CALCULATE DISCHARGE ENERGY
S330
CALCULATE DISCHARGE PATH LENGTH
S340
CALCULATE ENERGY DENSITY
S350
S360
IS ENERGY DENSITY GREATER THAN PREDETERMINED VALUE ?
NO
YES
INTEGRATE DISCHARGE PATH LENGTH
S370
S380
HAS PREDETERMINED PERIOD ELAPSED ?
NO
YES
SET FIRST THRESHOLD
S390
S400
IS INTEGRATED VALUE OF DISCHARGE PATH LENGTH LESS THAN FIRST THRESHOLD ?
YES
NO
S440
IS ABSOLUTE VALUE OF SECONDARY CURRENT LESS THAN SECOND THRESHOLD ?
NO
YES
S410
DETERMINE COMBUSTION TO BE FAVORABLE
S420
DETERMINE COMBUSTION TO BE UNFAVORABLE
PERFORM RE-DISCHARGE CONTROL
S430
END

IGNITION CONTROL SYSTEM

CROSS-REFERENCE TO RELATED APPLICATION

This application is based on and claims the benefit of priority from Japanese Patent Application No. 2016-236146, filed Dec. 5, 2016. The entire disclosure of the above application is incorporated herein by reference.

BACKGROUND

Technical Field

The present disclosure relates to an ignition control system that is used in an internal combustion engine.

Related Art

In recent years, technologies related to combustion control of lean air-fuel mixtures (lean-burn engines) and exhaust gas recirculation (EGR) have been studied for the purpose of improving fuel consumption in internal combustion engines for automobiles. In EGR, a combustible air-fuel mixture is recirculated back to the cylinders of an internal combustion engine. In these technologies, a multi-spark ignition system is sometimes used as an ignition system for effectively burning fossil fuel contained in an air-fuel mixture. In the multi-spark ignition system, a spark plug consecutively discharges a spark multiple times for each ignition timing of the internal combustion engine.

The multi-spark ignition system is problematic in that the spark plug and an ignition transformer that provides the spark plug with a high voltage become significantly degraded to a degree corresponding to the plurality of discharge operations performed during a single ignition cycle. In addition, even in cases in which the air-fuel mixture can be favorably ignited by an initial discharge, the discharge operation is unnecessarily repeated, resulting in waste of energy.

As a countermeasure, JP-A-2010-138880 discloses a following technology. That is, during a capacitive discharge period, when a voltage peak of a secondary voltage applied to an ignition transformer exceeds a determination threshold, a cumulative time of exceedance segments during which the voltage peak exceeds the determination threshold is measured. Alternatively, an integrated value of the secondary voltage in the exceedance segments is measured. Then, whether the air-fuel mixture is in a combustion state or a misfire state is determined based on the calculated cumulative time of the exceedance segments or integrated value of the secondary voltage in the exceedance segments.

JP-A-2010-138880 describes that, during capacitive discharge, the secondary voltage detected when the air-fuel mixture is combusting is lower than the secondary voltage detected when misfire of the air-fuel mixture has occurred. A reason for this is thought to be as follows. That is, ions are produced as a result of the air-fuel mixture being ignited by the discharge generated by the spark plug. As a result of these ions being present between electrodes of the spark plug, a secondary current more easily flows between the electrodes of the spark plug. Consequently, discharge resistance decreases. In accompaniment, the secondary voltage applied to the spark plug decreases.

Here, in a high flow field in which the rate of airflow in the combustion chamber is high, it is assumed that the combustion ions produced by ignition of the air-fuel mixture are carried by the airflow, causing a decrease in the amount of combustion ions present between the electrodes of the spark plug. In this state, the decrease in the discharge resistance is minimal. In accompaniment, the decrease in the secondary voltage applied to the spark plug also is minimal. In this case, in the technology described in JP-A-2010-138880, even when the air-fuel mixture is in the combustion state, an erroneous determination that the air-fuel mixture is in the misfire state may be made because the secondary voltage applied to the spark plug is in a high state. In this regard, there is still room for improvement in determination control for determining the combustion state of the air-fuel mixture.

SUMMARY

It is thus desired to provide an ignition control system that is capable of estimating a combustion state of a combustible air-fuel mixture with higher accuracy, and improving the combustion state of the combustible air-fuel mixture by performing re-discharge by a spark plug as required.

An exemplary embodiment of the present disclosure provides an ignition control system that is applied to an internal combustion engine.

The internal combustion engine includes: a spark plug that generates a discharge spark between a pair of discharge electrodes for igniting a combustible air-fuel mixture in a cylinder of the internal combustion engine; an ignition coil that includes a primary coil and a secondary coil, and applies a secondary voltage to the spark plug by the secondary coil; a voltage value detecting unit that detects a voltage value of at least either of a primary voltage applied to the primary coil and the secondary voltage applied to the spark plug; and a secondary current detecting unit that detects a secondary current flowing to the spark plug.

The ignition control system includes: a primary current control unit that performs discharge generation control one or more times during a single combustion cycle, the discharge generation control allowing the spark plug to generate the discharge spark by a primary current to the primary coil being interrupted after conduction of the primary current to the primary coil; a parameter calculating unit that successively calculates a parameter correlated with energy of the discharge spark based on the voltage value detected by the voltage value detecting unit; an energy density calculating unit that successively calculates energy density that is energy per unit length of the discharge spark; and an integrated value calculating unit that when the energy density calculated by the energy density calculating unit is greater than a predetermined value during a predetermined period after the primary current is interrupted during the single combustion cycle, calculates an integrated value by integrating the parameter calculated by the parameter calculating unit during the predetermined period. The primary current control unit performs the discharge generation control again when the integrated value calculated by the integrated value calculating unit is less than a predetermined determination threshold.

The inventors have found that a discharge spark of which the energy density is greater than a predetermined value contributes to combustion of a combustible air-fuel mixture, whereas a discharge spark of which the energy density is less than the predetermined value does not significantly contribute to the combustion of the combustible air-fuel mixture. That is, the inventors have found that whether or not the discharge spark generated by the spark plug contributes to combustion of the combustible air-fuel mixture can be estimated from the energy density of the discharge spark. Furthermore, whether or not the combustion state of the combustible air-fuel mixture is favorable can be more accurately estimated based on the integrated value of a parameter correlated with the energy of the discharge spark of which the energy density is greater than the predetermined value.

Therefore, in the present ignition control system, the energy density calculating unit is provided. The energy density, which is the energy per unit length of the discharge spark, is successively calculated. When the energy density of the discharge spark calculated by the energy density calculating unit is greater than the predetermined value during the predetermined period after the primary current is interrupted during the single combustion cycle, the integrated value calculating unit calculates the integrated value by integrating the parameter correlated with the energy of the discharge spark in the predetermined period. The calculated integrated value is the integrated value of the parameter of the discharge spark contributing to the combustion of the combustible air-fuel mixture during the predetermined period.

Therefore, when the integrated value integrated during the predetermined period is less than the predetermined determination threshold, an estimation can be made that the combustion state of the combustible air-fuel mixture is not favorable. As a result, the primary current control unit performs the discharge generation control again, when the integrated value calculated by the integrated value calculating unit is less than the predetermined determination threshold. Consequently, the combustion state of the combustible air-fuel mixture can be made favorable.

Meanwhile, when the integrated value calculated by the integrated value calculating unit is greater than the predetermined determination threshold, an estimation can be made that the combustion state of the combustible air-fuel mixture is favorable. Therefore, as a result of the primary current control unit not performing the discharge generation control again, unnecessary consumption of energy by the spark plug can be suppressed.

BRIEF DESCRIPTION OF THE DRAWINGS

In the accompanying drawings:

FIG. 12 is a flowchart of control performed by the ignition control circuit in another example.

DESCRIPTION OF THE EMBODIMENTS

Figure 1:
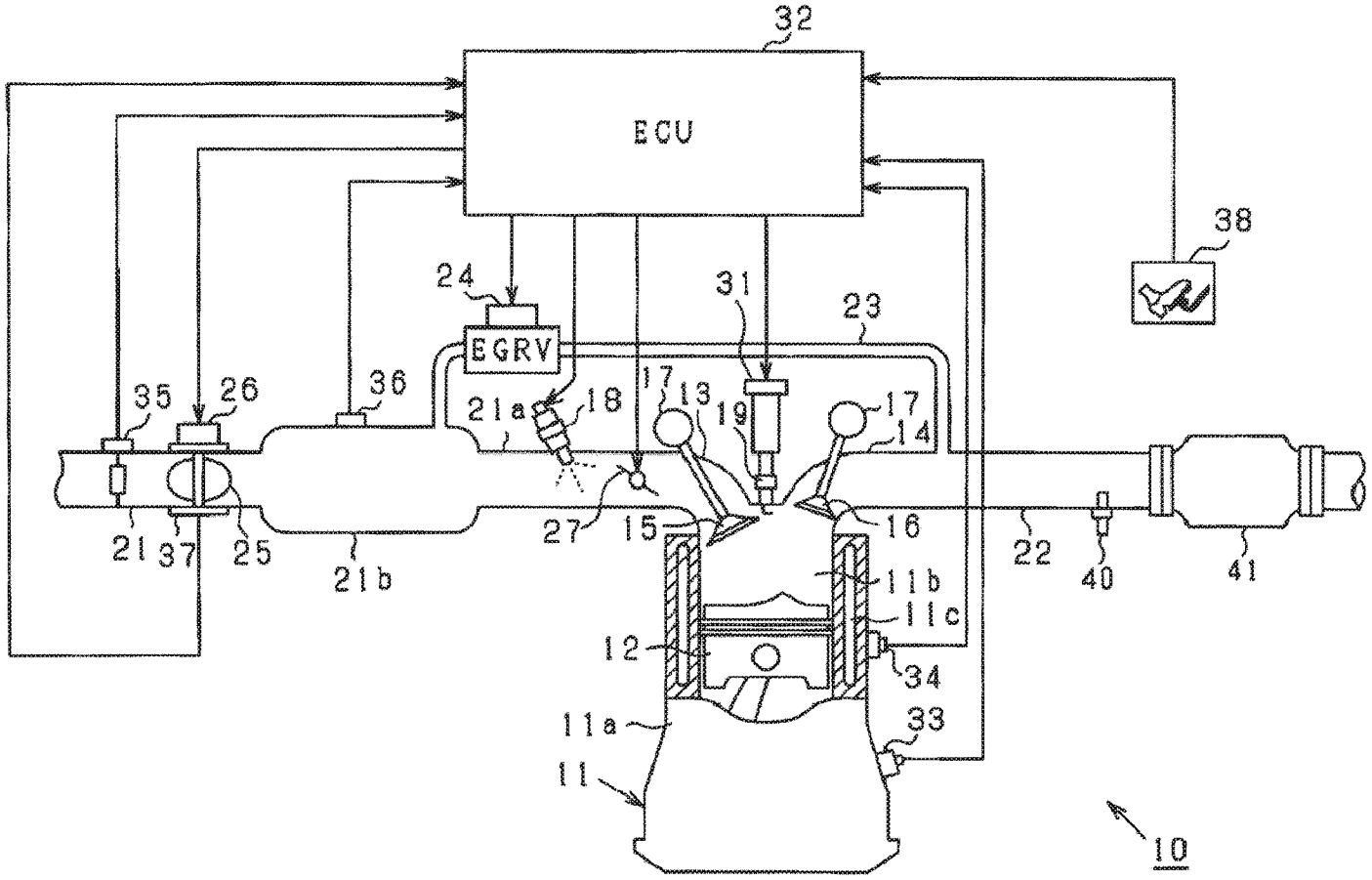
FIG. 1 is an overall configuration diagram of an engine system according to a present embodiment.

As shown in FIG. 1, an engine system 10 includes an engine 11 that is a spark ignition-type internal combustion engine. The engine system 10 controls changing of an air-fuel ratio of an air-fuel mixture to a rich side or a lean side in relation to a theoretical air-fuel ratio, based on an operation state of the engine 11. For example, when the operation state of the engine 11 is within an operation range that is low rotation and low load, the engine system 10 changes the air-fuel ratio of the air-fuel mixture to the lean side.

The engine 11 includes an engine block 11*a*, a combustion chamber 11*b*, and a water jacket 11*c*. The engine block 11*a* configures a main body portion of the engine 11. The combustion chamber 11*b* and the water jacket 11*c* are formed inside the engine block 11*a*. The engine block 11*a* is provided so as to house a piston 12 in a manner enabling reciprocal movement. The water jacket 11*c* is a space through which a coolant (also referred to as cooling water) is able to flow. The water jacket 11*c* is provided so as to surround the periphery of the combustion chamber 11*b*.

The engine block 11*a* has an upper portion that is a cylinder head. In cylinder head, an intake port 13 and an exhaust port 14 are formed so as to be communicable with the combustion chamber 11*b*. In addition, the cylinder head is provided with an intake valve 15, an exhaust valve 16, and a valve driving mechanism 17. The intake valve 15 is used to control the communication state between the intake port 13 and the combustion chamber 11*b*. The exhaust valve 16 is used to control the communication state between the discharge port 14 and the combustion chamber 11*b*. The valve driving mechanism 17 opens and closes the intake valve 15 and the discharge valve 16 at predetermined timings.

The intake port 13 is connected to an intake manifold 21*a*. The intake manifold 21*a* includes an electromagnetically-driven injector 18. The injector 18 receives high-pressure fuel from a fuel supply system. The injector 18 is a port injection-type fuel injection valve that sprays fuel towards the intake port 13 in accompaniment with energization.

A surge tank 21*b* is disposed further upstream from the intake manifold 21*a* in an intake airflow direction. The exhaust port 14 is connected to an exhaust pipe 22.

An EGR passage 23 connects the exhaust pipe 22 and the surge tank 21*b*, thereby enabling a portion of exhaust gas discharged from the exhaust pipe 22 to be introduced to the intake air (hereafter, the exhaust gas that is introduced to the intake air is referred to as an EGR gas). An EGR control valve 24 is provided in the EGR passage 23. The EGR control valve 24 is capable of controlling an EGR rate (the proportion of EGR gas contained in the gas before combustion that is taken into the combustion chamber 11*b*) based on a degree of opening thereof. Therefore, the EGR passage 23 and the EGR control valve 24 correspond to an exhaust gas recirculation mechanism.

A throttle valve 25 is provided in an intake pipe 21, further upstream from the surge tank 21*b* in the intake airflow direction. A degree of opening of the throttle valve 25 is controlled by operation of a throttle actuator 26, such as a direct-current (DC) motor. In addition, an airflow control valve (corresponding to an airflow generating unit) 27 is provided near the intake port 13. The airflow control valve 27 generates a swirl flow or a tumble flow.

A catalyst 41, such as a three-way catalyst, is provided in the exhaust pipe 22. The catalyst 41 cleans CO, HC, $NO_X$, and the like from the exhaust gas. An air-fuel ratio sensor 40 (such as a linear A/F sensor) is provided upstream of the catalyst 41. The air-fuel ratio sensor 40 detects the air-fuel ratio of an air-fuel mixture, with respect to the exhaust gas that is a detected object.

The engine system 10 includes an ignition circuit unit 31, an electronic control unit 32, and the like.

The ignition circuit unit 31 is configured to make a spark plug 19 generate a discharge spark to ignite an air-fuel mixture inside the combustion chamber 11*b*. The electronic control unit 32 is a so-called engine electronic control unit (ECU). The electronic control unit 32 controls operation of each unit including the injector 18 and the ignition circuit unit 31, based on the operation state of the engine 11 (simply referred to, hereafter, as engine parameters) acquired based on the outputs of various sensors, such as a crank angle sensor 33.

Regarding ignition control, the electronic control unit 32 generates an ignition signal IGt based on the acquired engine parameters and outputs the generated ignition signal IG The ignition signal IGt prescribes optimal ignition timing and discharge current (ignition discharge current), based on the state of the gas inside the combustion chamber 11*b* and the required output of the engine 11 (both of which vary based on the engine parameters).

The crank angle sensor 33 outputs a rectangular crank angle signal at every predetermined crank angle (such as a 30 degree crank angle (CA) interval) of the engine 11. The crank angle sensor 33 is mounted in the engine block 11*a*. A cooling-water temperature sensor 34 detects (acquires) a cooling water temperature, which is the temperature of the coolant flowing through the water jacket 11*c*. The coolant temperature sensor 34 is mounted in the engine block 11*a*.

An airflow meter 35 detects (acquires) an intake-air amount (a mass flow rate of the intake air introduced into the combustion chamber 11*b* via the intake pipe 21). The airflow meter 35 is mounted in the intake pipe 21, further upstream from the throttle valve 25 in the intake airflow direction. An intake pressure sensor 36 detects (acquires) intake pressure, which is the pressure within the intake pipe 21. The intake-air pressure sensor 36 is mounted in the surge tank 21*b*.

A throttle position sensor 37 generates an output that corresponds to the degree of opening (throttle position) of the throttle valve 25. The throttle position sensor 37 is provided within the throttle actuator 26. An accelerator position sensor 38 generates an output that corresponds to an accelerator operating amount.

<Configuration of the Ignition Circuit Unit and Surrounding Area>

Figure 2:
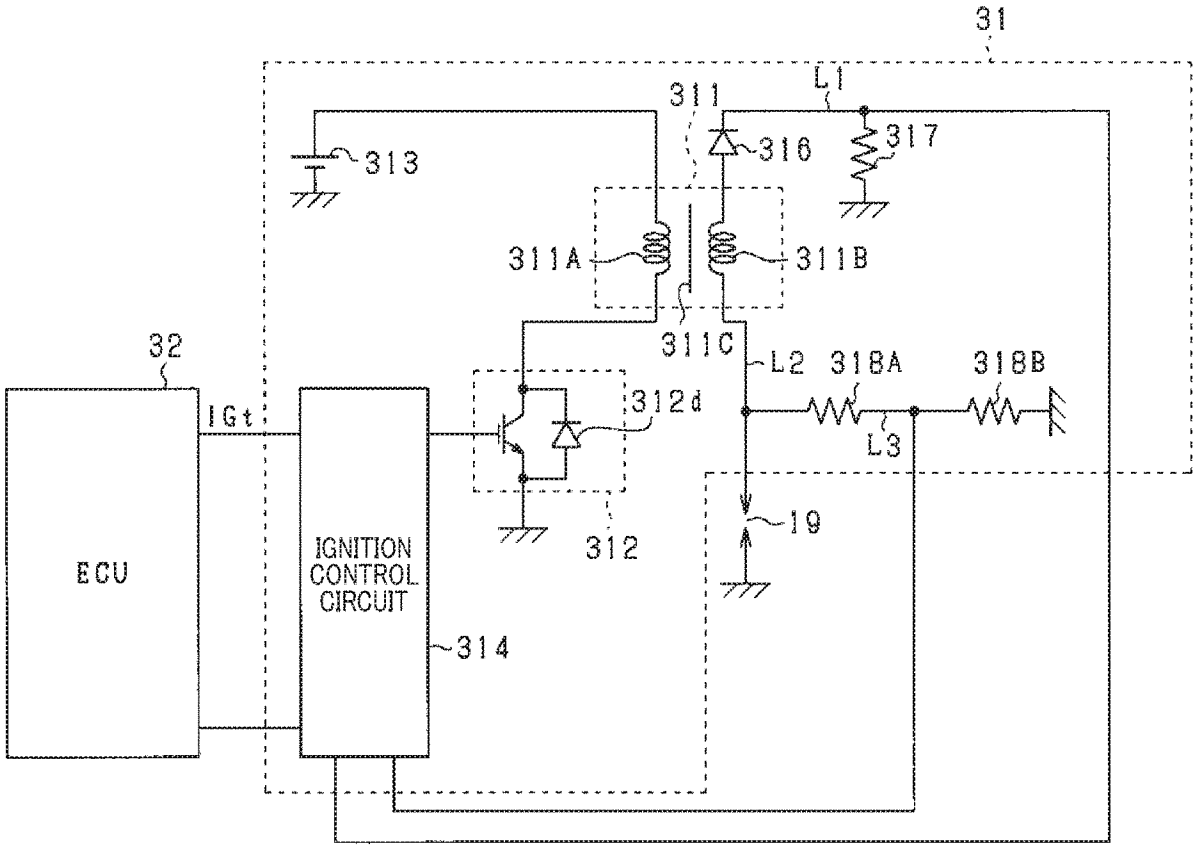
FIG. 2 is an overall configuration diagram of an ignition circuit unit shown in FIG. 1.

As shown in FIG. 2, the ignition circuit unit 31 includes an ignition coil 311, an insulated-gate bipolar transistor (IGBT) 312 (corresponding to a switching element), a power supply unit 313, and an ignition control circuit 314.

The ignition coil 311 includes a primary coil 311A, a secondary coil 311B, and a core 311C. A first end of the primary coil 311A is connected to the power supply unit 313. A second end of the primary coil 311A is connected to a collector terminal of the IGBT 312. An emitter terminal of the IGBT 312 is connected to a ground side. A diode 312*d* is connected in parallel to both ends (the collector terminal and the emitter terminal) of the IGBT 312.

A first end of the secondary coil 311B is connected to a current detection path L1 via a diode 316. A resistor 317 for detecting a secondary current is provided on the current detection path L1. A first end of the resistor 317 is connected to the first end of the secondary coil 311B via the diode 316. A second end of the resistor 317 is connected to the ground side. The ignition control circuit 314, described hereafter, is connected to the resistor 317. An anode of the diode 316 is connected to the first end side of the secondary coil 311B such that the diode 316 prohibits the flow of current in a direction from the ground side towards the second end side of the secondary coil 311B via the resistor 317, and prescribes the direction of a secondary current (discharge current) I2 to a direction from the spark plug 19 towards the secondary coil 311B.

The second end of the secondary coil 311B is connected to the spark plug 19. A voltage detection path (corresponding to a voltage value detecting unit) L3 is connected to a path L2 that connects the second end of the secondary coil 311B and the spark plug 19. Resistors 318A and 318B for detecting the voltage are provided on the voltage detection path L3. One end of the resistor 318A is connected to the path L2. The other end of the resistor 318A is connected to the resistor 318B. One end of the resistor 318B is connected to the resistor 318A. The other end of the resistor 318B is connected to the ground side. In addition, a node (reference number is omitted) between the resistor 318A and the resistor 318B is connected to the ignition control circuit 314, described hereafter. A secondary voltage V2 applied to the spark plug 19 is detected by the voltage detection path L3.

The electronic control unit 32 generates the ignition signal IGt based on the acquired engine parameters, as described above. The electronic control unit 32 then transmits the generated ignition signal IGt to the ignition control circuit 314. The ignition control circuit 314 outputs a drive signal IG to a gate terminal of the IGBT 312 based on the ignition signal IGt received from the electronic control unit 32, and makes the IGBT 312 conduct a primary current I1 flowing to the primary coil 311A. The drive signal IG is used to perform open-close control of the IGBT 312.

The electronic control unit 32 stops outputting the ignition signal IGt after the elapse of a first predetermined amount of time. As a result, the ignition control circuit 314 stops outputting the drive signal IG to the gate terminal of the IGBT 312. As a result, the IGBT 312 interrupts the conduction of the primary current I1 flowing to the primary coil 311A. A high voltage is induced in the secondary coil 311B. Breakdown of the gas in a spark gap portion of the spark plug 19 occurs and the spark plug 19 generates the discharge spark.

The ignition control circuit 314 successively detects a secondary current I2 flowing to the current detection path L1 and the secondary voltage V2 applied to the voltage detection path L3. The ignition control circuit 314 then calculates an energy density D of the discharge spark generated by the spark plug 19 based on the detected secondary current I2 and secondary voltage V2. Therefore, the current detection path L1 and the ignition control circuit 314 correspond to a secondary current detecting unit. The voltage detection path L3 and the ignition control circuit 314 correspond to a voltage detecting unit. In addition, the ignition control circuit 314 corresponds to a primary current control unit, a parameter calculating unit, an energy density calculating unit, an integrated value calculating unit, a discharge path length calculating unit, and a discharge energy calculating unit.

In the conventional technology described above, when the combustible air-fuel mixture present in the combustion chamber 11*b* is burned as a result of the spark plug 19 generating the discharge spark, the combustion state of the combustible air-fuel mixture is estimated based on the changes in the secondary voltage V2 applied to the spark plug 19. Specifically, when the voltage peak of the secondary voltage V2 of the discharge spark generated by the spark plug 19 exceeds a predetermined determination threshold, the cumulative time of the exceedance segments in which the voltage peak exceeds the predetermined determination threshold is measured. Alternatively, the integrated value of the secondary voltage V2 in the exceedance segments is measured. Then, whether the combustible air-fuel mixture is in the combustion state or the misfire state is determined based on the measured cumulative time of the exceedance segments or integrated value of the secondary voltage V2 in the exceedance segments.

Here, in the engine system 10 according to the present embodiment, the airflow control valve 27 is provided near the intake port 13. When homogenous lean burn is performed, the airflow control valve 27 generates an airflow, such as a swirl flow or a tumble flow, in the combustion chamber 11*b*. As a result, turbulence is induced and combustion speed is improved.

At this time, because the speed of airflow within the combustion chamber 11*b* increases, it is assumed that the combustion ions generated as a result of ignition of the combustible air-fuel mixture are carried by the airflow, and the combustion ions present between the electrodes of the spark plug 19 decrease. In this state, the decrease in discharge resistance is minimal. In accompaniment, the decrease in the secondary voltage V2 applied to the spark plug 19 is also minimal.

Therefore, even should the combustible air-fuel mixture be in the combustion state when the combustion state of the combustible air-fuel mixture is estimated based on the secondary voltage V2, the combustible air-fuel mixture may be erroneously estimated as being in the misfire state because the secondary voltage V2 that is applied to the spark plug 19 is in a high state.

As a countermeasure, according to the present embodiment, the combustion state of the combustible air-fuel mixture is estimate based on the energy density D of the discharge spark and a parameter correlated with the energy of the discharge spark. The inventors have found that a discharge spark of which the energy density D is greater than a predetermined value Th contributes to combustion of the combustible air-fuel mixture. A discharge spark of which the energy density D is less than the predetermined value Th does not significantly contribute to the combustion of the combustible air-fuel mixture. That is, the inventors have found that whether or not the discharge spark generated by the spark plug 19 contributes to combustion of the combustible air-fuel mixture can be estimated from the energy density D of the discharge spark. Furthermore, the combustion state of the combustible air-fuel mixture can be determined with high accuracy based on an integrated value of the parameter correlated with the energy of the discharge spark of which the energy density D is greater than the predetermined value Th.

Based on these findings, the ignition control circuit 314 according to the present embodiment performs combustion state determination control, described hereafter. In the combustion state determination control, during a predetermined period from when the IGBT 312 interrupts the conduction of the primary current I1 flowing to the primary coil 311A, an integration process is performed when the energy density D of the discharge spark calculated by a calculation method described hereafter is greater than the predetermined value Th. In the integration process, the parameter correlated with the energy of the discharge spark in the predetermined period is integrated. Then, upon elapse of the predetermined period, a combustion state determination process for the combustible air-fuel mixture, described hereafter, is performed based on the integrated value of the parameter correlated with the energy of the discharge spark calculated in the integration process.

According to the present embodiment, the energy density D of the discharge spark is defined as discharge energy E per unit length of the discharge spark. Therefore, the energy density D of the discharge spark is calculated by the discharge energy E being divided by the discharge path length L, as indicated in expression (1).

$$D=E\div L \tag{1}$$

Here, the discharge path length L is the length of the discharge spark.

The discharge energy E can be determined from a product of the secondary current I2 and the secondary voltage V2, as is already well known (see expression (2)).

$$E=I1\times V2 \tag{2}$$

Figure 3:
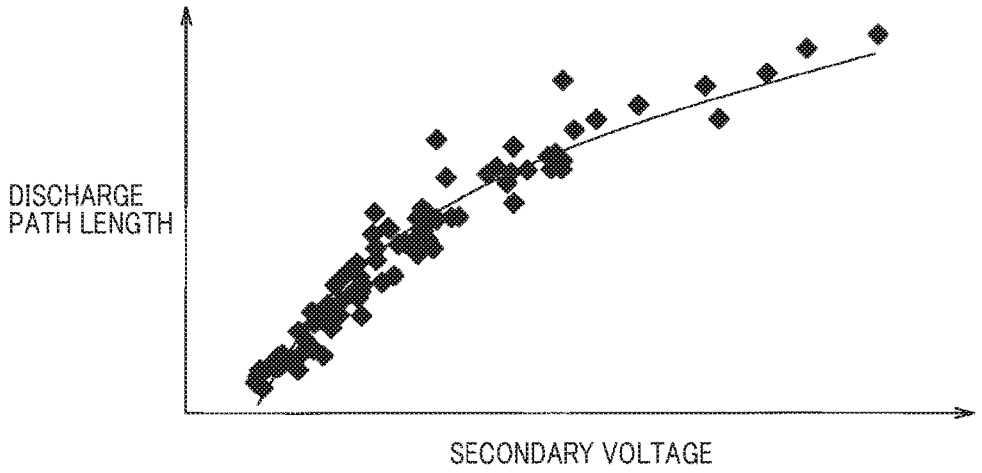
FIG. 3 is a graph of a relationship between secondary voltage and discharge path length.

Meanwhile, as shown in FIG. 3, regarding the discharge path length L, it has been found that the relationship between the secondary voltage V2 and the discharge path length L can be accurately approximated by a natural logarithm. Therefore, as indicated in expression (3), the discharge path length L is calculated based on a natural logarithm value of the absolute value of the secondary voltage V2.

$$L=a\times 1n(V2)+b \tag{3}$$

Here, a and b are constants that appropriately prescribe the relationship between the secondary voltage V2 and the discharge path length L.

The discharge energy E and the discharge path length L are both successively calculated from the detected secondary current I2 and secondary voltage V2. The energy density D of the discharge spark is also successively calculated based on the calculated discharge energy E and discharge path length L.

According to the present embodiment, the discharge path length L is set as the parameter correlated with the energy of the discharge spark. The combustion state determination control in this case will be described with reference to FIG. 4.

Figure 4:
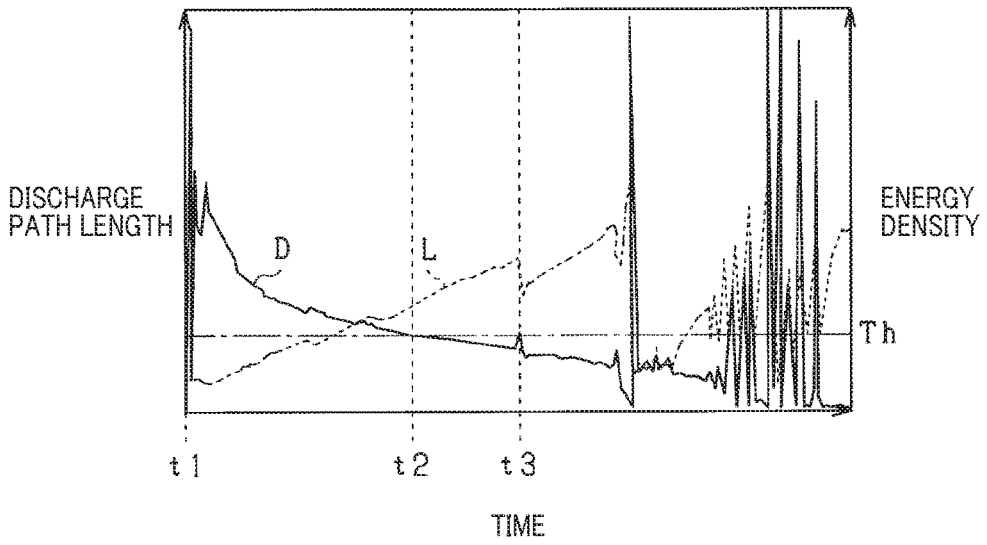
FIG. 4 is a diagram of an aspect of changes over time in energy density and discharge path length of a discharge spark.

FIG. 4 shows the changes over time in the energy density D and the discharge path length L of the discharge spark subsequent to the discharge spark being generated by the spark plug 19 as a result of the IGBT 312 interrupting the conduction of the primary current I1 flowing to the primary coil 311A.

During the predetermined period (see time t1 to t3) from when the IGBT 312 interrupts the conduction of the primary current I1 flowing to the primary coil 311A, the discharge path length L of the discharge spark calculated in the predetermined period is integrated until the energy density D of the discharge spark becomes less than the predetermined value Th (see time t2). As indicated in expression (4), an integration formula for the discharge path length L of the discharge spark of which the energy density D is greater than the predetermined value Th is determined by integration of the product of the discharge path length L and a step function u of a value obtained by the predetermined value Th being subtracted from the energy density D.

$$V=\int L\times u(D-Th)dt \quad (4)$$

The combustion state determination process is performed upon elapse of the predetermined period. Specifically, a determination is made regarding whether or not the integrated value of the discharge path length L calculated in the integration process (referred to, hereafter, as an integrated value of the discharge path length L having a large energy density) is less than a first threshold (i.e., a predetermined determination threshold corresponding to a first determination threshold). Regarding the integrated value of the discharge path length L, when the energy density D of the discharge spark is greater than the predetermined value Th, the discharge path length L of the discharge spark in the predetermined period is integrated.

When the integrated value of the discharge path length L having a large energy density that has been integrated is determined to not be less than the first threshold, the discharge spark is determined to sufficiently contribute to the combustion of the combustible air-fuel mixture. Therefore, the combustion state of the combustible air-fuel mixture is determined to be favorable, and the discharge control is ended. Meanwhile, when the integrated value of the discharge path length L having a large energy density that has been integrated is determined to be less than the first threshold, the discharge spark is determined to not sufficiently contribute to the combustion of the combustible air-fuel mixture. The combustion state of the combustible air-fuel mixture is determined to be unfavorable, and re-discharge control is performed.

In the re-discharge control, first, the drive signal IG is outputted to the gate terminal of the IGBT 312 again, thereby ending the generation of the discharge spark by the spark plug 19. As a result, energy is supplied from the power supply unit 313 to the primary coil 311A. Then, after the elapse of a second predetermined amount of time, the ignition control circuit 314 stops outputting the drive signal IG to the gate terminal of the IGBT 312 and makes the spark plug 19 perform re-discharge. The second predetermined amount of time is set to be shorter than the first predetermined amount of time. A reason for this is that it is assumed that power is still stored in the primary coil 311A when the generation of the discharge spark by the spark plug 19 is ended. Therefore, the amount of time required for accumulation of power necessary to enable the spark plug 19 to perform re-discharge is expected to be short.

According to the present embodiment, determination of the combustion state of the combustible air-fuel mixture is performed even when the re-discharge control is performed. As a result of the re-discharge control being performed, the discharge spark that is generated again by the spark plug 19 continues to heat the combustible air-fuel mixture that has been heated by the discharge spark generated by the spark plug 19 up to this time. Therefore, the integrated value of the discharge path length L having a large energy density calculated during the predetermined period when the re-discharge is performed is added to the integrated value of the discharge path length L calculated up to this time during a single combustion cycle.

When a total value calculated as a result is less than a first threshold, the combustion state of the combustible air-fuel mixture is assumed to still be unfavorable. Therefore, the re-discharge control is performed. Meanwhile, when the total value is not less than the first threshold, the combustion state of the combustible air-fuel mixture is assumed to have become favorable. Therefore, discharge generation control is not performed again.

As a result such control being performed, control can be performed such that the integrated value is greater than the first threshold. In addition, the number of times that the discharge generation control is performed to achieve a favorable combustion state of the combustible air-fuel mixture can be kept at a minimum.

Here, combustion of the combustible air-fuel mixture becomes more difficult as the air-fuel ratio inside the combustion chamber 11*b* shifts towards the lean side. Consequently, to enable favorable combustion of the combustible air-fuel mixture, a discharge spark of which the energy density D is greater than the predetermined value Th is required to be generated over a longer amount of time. Therefore, the ignition control circuit 314 sets the first threshold to a greater value as the air-fuel ratio becomes greater (shifts towards the lean side).

In addition, in the engine 11 provided with the EGR passage 23 as according to the present embodiment, combustion of the combustible air-fuel mixture becomes more difficult as the EGR rate increases because the proportion of the EGR gas in the combustion chamber 11*b* increases. When a large amount of EGR gas is present, the discharge spark of which the energy density D is greater than the predetermined value Th is required to be generated over a longer amount of time to enable favorable combustion of the combustible air-fuel mixture. Therefore, the ignition control circuit 314 sets the first threshold to a greater value as the EGR rate increases.

When the spark plug 19 generates the discharge spark as a result of the primary current I1 being interrupted, noise is assumed to be generated in the secondary voltage V2 applied to the voltage detection path L3 and the secondary current I2 flowing to the current detection path L1. During the period over which the noise is generated, the above-described combustion state determination control is preferably not performed because the calculated discharge energy E and discharge path length L of the discharge spark is thought to include errors.

Taking the foregoing into consideration, according to the present embodiment, a predetermined mask period is set. The starting point of the mask period is immediately after the IGBT 312 interrupts the conduction of the primary current I1 flowing to the primary coil 311A. The above-described predetermined period during which the discharge path length L having a large energy density is integrated is set such that the mask period is excluded.

In addition, when the period over which the spark plug 19 generates the discharge spark is long, the discharge spark elongates into a U-shape as a result of the airflow in the combustion chamber 11*b*. At this time, when a section is present in which the distance between spark discharges that face each other is short, discharge short-circuiting may occur. In the discharge short-circuiting, the spark discharges join at this section and an elongated portion of the discharge spark beyond this section disappears. Noise is generated in the secondary voltage V2 and the secondary current I2 when the discharge short-circuiting occurs, as well.

Therefore, the above-described predetermined period during which the discharge path length L having a large energy density is integrated is set so as not to overlap a period during which the probability of short-circuiting of the discharge spark generated by the spark plug 19 increases.

Figure 5:
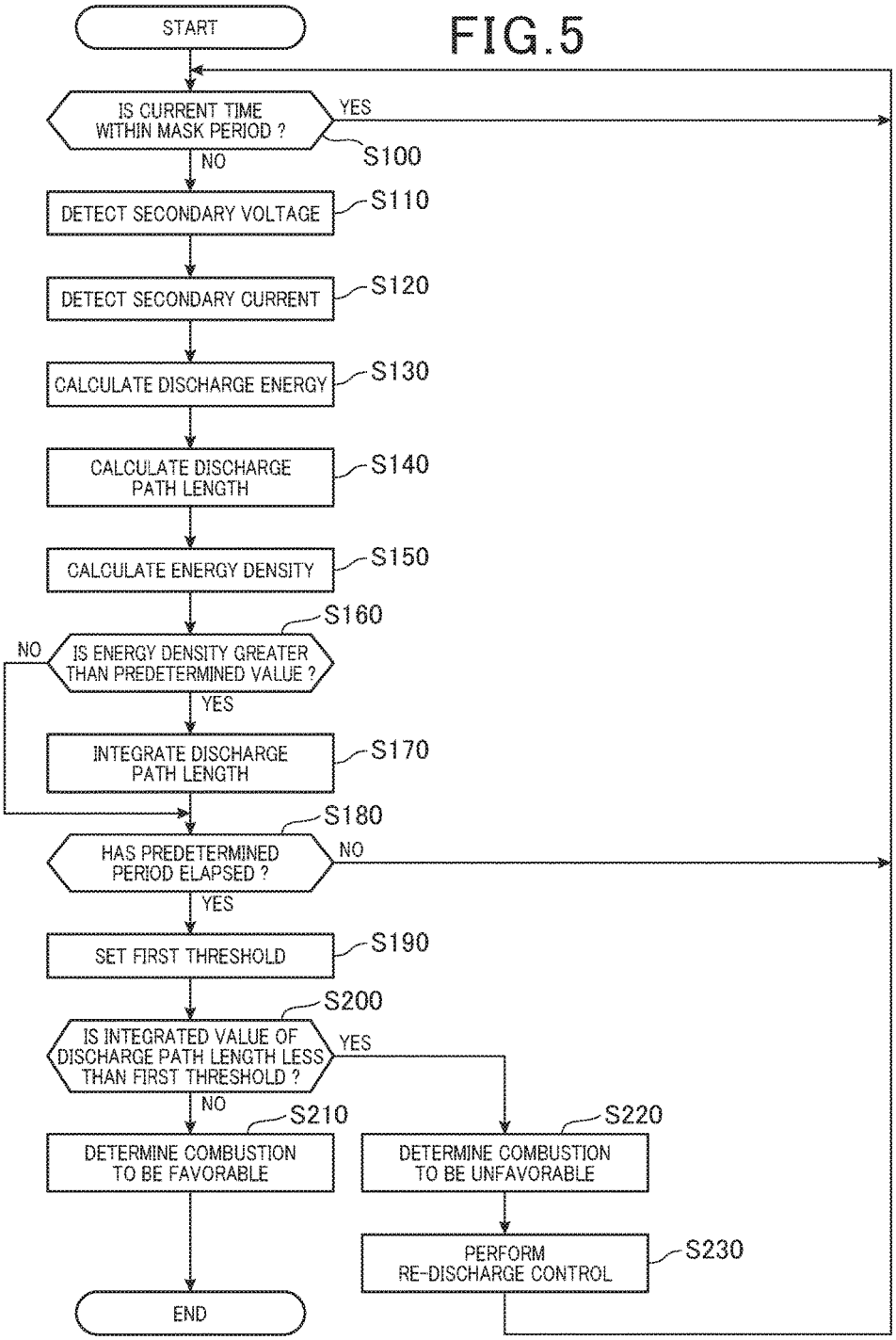
FIG. 5 is a flowchart of control performed by an ignition control circuit according to the present embodiment.

According to the present embodiment, the ignition control circuit 314 performs the combustion state determination control that is described hereafter and shown in FIG. 5. The ignition control circuit 314 repeatedly performs the combustion state determination control shown in FIG. 5 at a predetermined cycle, during a discharge period over which the spark plug 19 performs discharge. The discharge period starts when the IGBT 312 interrupts conduction of the primary current I1 flowing to the primary coil 311A.

First, at step S100, the ignition control circuit 314 determines whether or not the current time is within the mask period. When determined that the current time is within in the mask period (NO at S100), the ignition control circuit 314 proceeds to step S110.

At step S110, the ignition control circuit 314 detects the secondary voltage V2 applied to the voltage detection path L3. At step S120, the ignition control circuit 314 detects the secondary current I2 flowing to the current detection path L1.

At step S130, the ignition control circuit 314 calculates the discharge energy E that is the product of the secondary voltage V2 and the secondary current I2 detected at step S110 and step S120. At step S140, the ignition control circuit 314 calculates the discharge path length L based on the natural logarithm value of the absolute value of the secondary voltage V2. At step S150, the ignition control circuit 314 calculates the energy density D of the discharge spark by dividing the discharge energy E by the discharge path length L.

At step S160, the ignition control circuit 314 determines whether or not the energy density D of the discharge spark calculated at step S150 is greater than the predetermined value Th. When determined that the energy density D of the discharge spark is not greater than the predetermined value Th (NO at S160), the ignition control circuit 314 proceeds to step S180 described hereafter. When determined that the energy density D of the discharge spark is greater than the predetermined value Th (YES at S160), the ignition control circuit 314 proceeds to step S170. At step S170, the ignition control circuit 314 integrates the discharge path length L calculated at step S140.

At step S180, the ignition control circuit 314 determines whether or not the predetermined period during which the discharge path length L is integrated has elapsed. When determined that the predetermined period has elapsed (YES at S180), the ignition control circuit 314 proceeds to step S190. At step S190, the ignition control circuit 314 sets the first threshold based on the air-fuel ratio detected by the air-fuel ratio sensor 40 and the EGR rate calculated based on the degree of opening of the EGR control valve 24. At step S200, the ignition control circuit 314 determines whether or not the integrated value of the discharge path length L integrated at step S170 is less than the first threshold. When determined that the integrated value of the discharge path length L is not less than the first threshold (NO at S200), the ignition control circuit 314 proceeds to step S210. The ignition control circuit 314 determines that the combustion state of the combustible air-fuel mixture is favorable and ends the present control. When determined that the integrated value of the discharge path length L is less than the first threshold (YES at S200), the ignition control circuit 314 proceeds to step S220. The ignition control circuit 314 determines that the combustion state of the combustible air-fuel mixture is unfavorable and proceeds to step S230. At S230, the ignition control circuit 314 performs the re-discharge control and returns to step S100.

When determined that the current time is within the mask period (YES at S100), or when determined that the predetermined period has not elapsed (NO at S180), the ignition control circuit 314 returns to step S100.

A part of the combustion state determination control is modified for the combustion state determination control performed during the re-discharge control. Specifically, the determination process at step S200 is modified such that a determination is made regarding whether or not the total value of the integrated value of the discharge path length L integrated at step S170 and the integrated value of the discharge path length L calculated up to this point during a single combustion cycle is less than the first threshold. Other steps are identical to the steps in the combustion state determination control performed during the initial discharge.

The process at step S130 corresponds to a process executed by the discharge energy calculating unit. The process at step S140 corresponds to a process executed by the discharge path length calculating unit. The process at step S140 corresponds to a process executed by the parameter calculating unit. The process at step S150 corresponds to a process executed by the energy density calculating unit. The processes at step S160 and step S170 correspond to a process executed by the integrated value calculating unit.

Next, an aspect of the combustion state determination control according to the present embodiment will be described with reference to FIG. 6.

Figure 6:
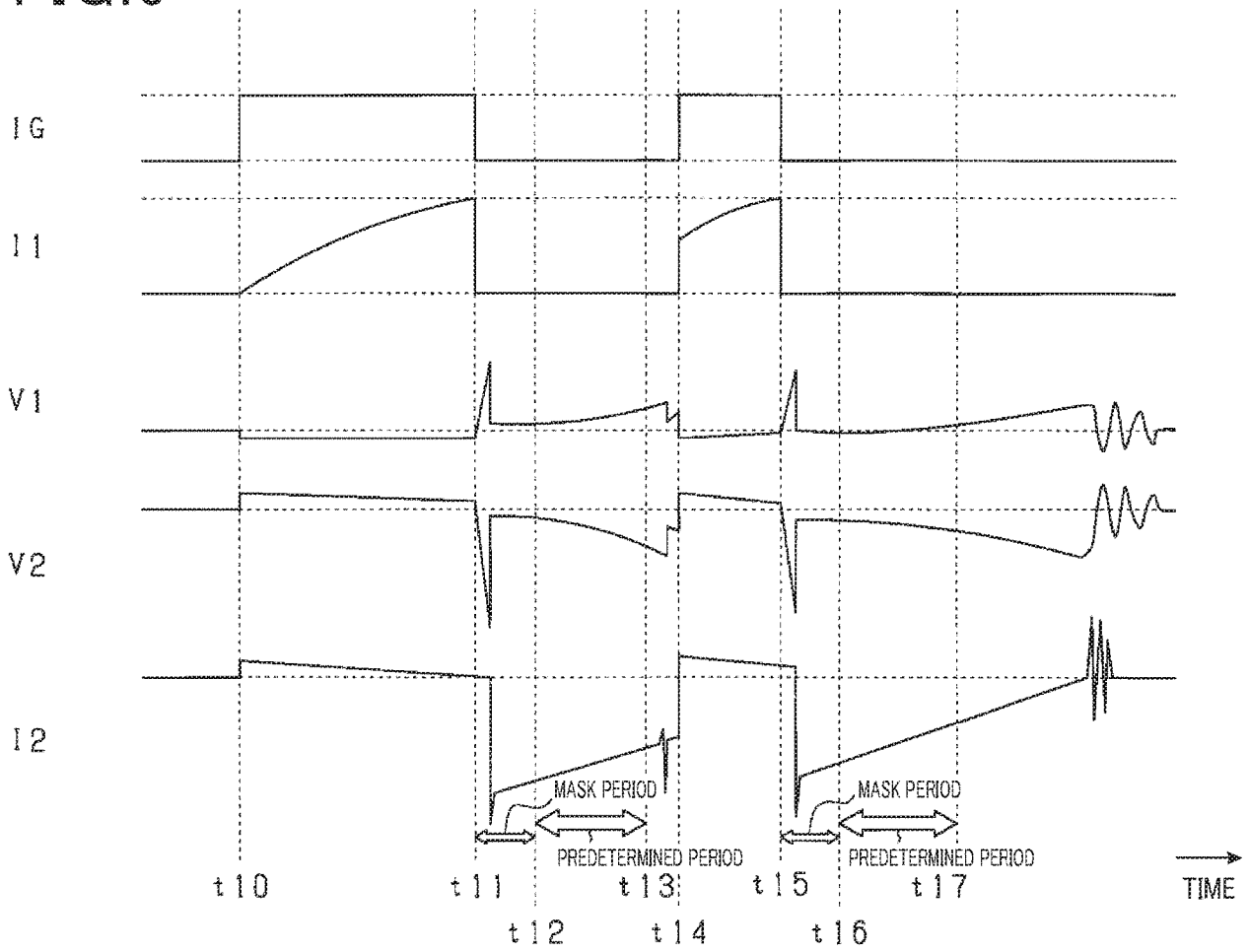
FIG. 6 is a time chart of operations in combustion state determination control according to the present embodiment.

In FIG. 6, "IG" indicates whether or not the drive signal IG is outputted to the gate terminal of the IGBT 312 by high/low. "I1" indicates the value of the primary current I1 that flows to the primary coil 311A. "V1" indicates the value of the primary voltage V1 applied to the primary coil 311A. "V2" indicates the secondary voltage V2 applied to the spark plug 19. "I2" indicates the value of the secondary current I2 flowing to the spark plug 19.

The ignition control circuit 314 that has received the ignition signal IGt from the electronic control unit 32 transmits the drive signal IG to the gate terminal of the IGBT 312 (see time t10). As a result, the IGBT 312 closes, and the primary current I1 flows to the primary coil 311A. Then, after the elapse of the first predetermined amount of time, the electronic control unit 314 stops outputting the ignition signal IGt to the ignition control circuit 314. In accompaniment, the ignition control circuit 314 stops outputting the drive signal IG to the gate terminal of the IGBT 312 (see time t11). As a result, the IGBT 312 is opened. Conduction of the primary current I1 flowing to the primary coil 311A is interrupted. The secondary voltage V2 is induced in the secondary coil 311B. Breakdown of the gas in the spark gap portion of the spark plug 19 occurs, and the spark plug 19 generates the discharge spark.

Until the elapse of the predetermined mask period (see time t11 to t12) after the spark plug 19 generates the discharge spark (after conduction of the primary current I1 flowing to the primary coil 311A is interrupted), the energy density D of the discharge spark generated by the spark plug 19 is not calculated. During the predetermined period (see time t12 to t13) set after the predetermined mask period, the energy density D of the discharge spark generated by the spark plug 19 is calculated based on the detected secondary voltage V2 and secondary current I2. When the calculated energy density D is greater than the predetermined value Th, the discharge path length L of the discharge spark in the predetermined period is integrated.

After the elapse of the predetermined period (see time t13), a determination is made regarding whether or not the integrated value of the discharge path length L having a large energy density that has been integrated during the predetermined period is less than the first threshold. When the integrated value of the discharge path length L having a large energy density that has been integrated during the predetermined period is determined to be less than the first threshold, the ignition control circuit 314 transmits the drive signal IG to the gate terminal of the IGBT 312 again (see time t14). Subsequently, upon elapse of the second predetermined amount of time, the output of the drive signal IG to the gate terminal of the IGBT 312 is stopped (see time t14 to t15). As a result, the spark plug 19 generates the discharge spark again.

In a manner similar to that during the initial discharge, the predetermined mask period is provided during the re-discharge as well. Until the elapse of the predetermined mask period (see time t15 to t16) after the spark plug 19 generates the discharge spark, the energy density D of the discharge spark generated by the spark plug 19 is not calculated. During the predetermined period set after the predetermined mask period, when the calculated energy density D is greater than the predetermined value Th, the discharge path length L of the discharge spark in the predetermined period is integrated (see time t16 to t17).

After the elapse of the predetermined period (see time t17), a determination is made regarding whether or not the total value of the integrated value of the discharge path length L having a large energy density integrated during the predetermined period and the integrated value of the discharge path length L having a large energy density integrated up to this point during a single combustion cycle is less than the first threshold. When the total value is determined to not be less than the first threshold, the re-discharge control is not performed and the discharge control is immediately ended.

During the time segment t13 to t14, significant variations occur in the primary voltage V1, the secondary voltage V2, and the secondary current I2. A reason for this is thought to be that short-circuiting of the discharge spark generated by the spark plug 19 has occurred. In this way, when the discharge short-circuiting occurs, significant variations occur in the primary voltage V1, the secondary voltage V2, and the secondary current I2. Therefore, the end of the predetermined period is preferably set to be before the period in which the occurrence of discharge short-circuiting becomes more likely.

According to the present embodiment, the following effects are achieved as a result of the above-described configuration.

The re-discharge control is performed when the integrated value calculated during the predetermined period is less than the first threshold. As a result, the combustion state of the combustible air-fuel mixture can be made favorable.

Figure 7:
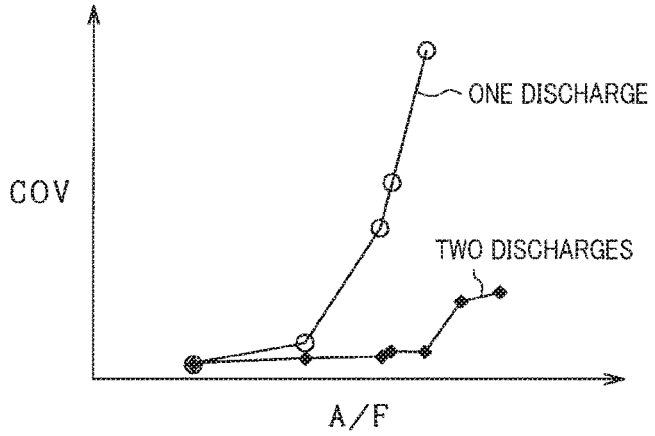
FIG. 7 is a graph of a comparison of changes in torque variation rate accompanying increase in air-fuel ratio when discharge is performed once and when discharge is performed twice.
Figure 8A:
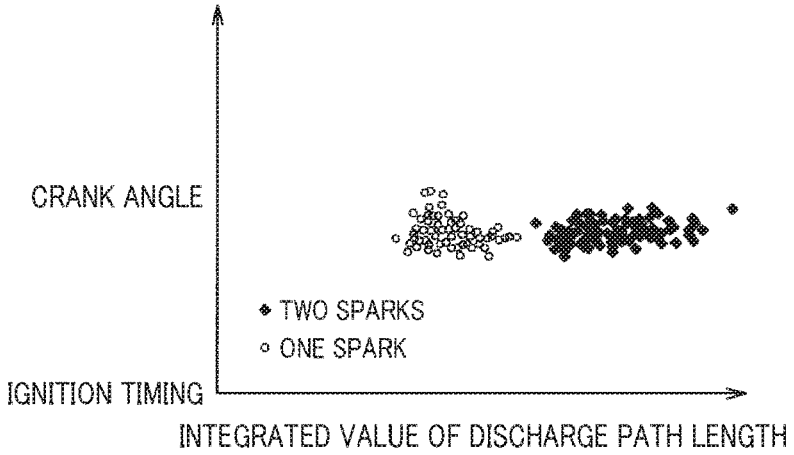
FIGS. 8A and 8B are diagrams of a relationship between an integrated value of discharge path lengths having a large energy density and crank angle passed before combustion of 2% of a combustible air-fuel mixture.
Figure 8B:
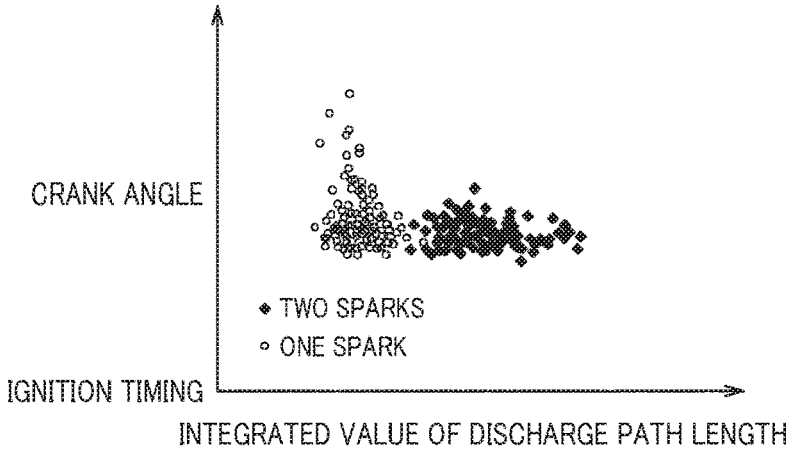

FIGS. 7, 8A, and 8B show that the combustion state of the combustible air-fuel mixture is actually improved as a result of the re-discharge control being performed.

In FIG. 7, regarding the amount of variation in the torque variation rate of the engine 11 that occurs as the air-fuel ratio in the combustion chamber 11*b* shifts towards the lean side, data obtained when the spark plug 19 generates the discharge spark only once and data obtained when the spark plug 19 generates the discharge spark twice according to the present embodiment are compared. FIG. 7 clearly indicates that the torque variation rate increases as the air-fuel ratio increases (as the air-fuel ratio shifts towards the lean side), when the spark plug 19 generates the discharge spark only once.

That is, the data suggests that the frequency of misfire in the engine 11 increases as the air-fuel ratio increases. Meanwhile, when the spark plug 19 generates the discharge spark twice according to the present embodiment, the variation in the torque variation rate when the air-fuel ratio increases can be reduced, compared to when the spark plug 19 generates the discharge spark only once. Thus, the data suggests that the spark plug 19 generating the discharge spark twice according to the present embodiment better enables reduction in the frequency of misfire in the engine 11.

FIG. 8A compares (i) data obtained when the spark plug 19 generates the discharge spark only once and (ii) data obtained when the spark plug 19 generates the discharge spark twice according to the present embodiment, in an environment in which the air-fuel ratio in the combustion chamber 11*b* shifts towards the rich side.

FIG. 8B compares (i) data obtained when the spark plug 19 generates the discharge spark only once and (ii) data obtained when the spark plug 19 generates the discharge spark twice according to the present embodiment, in an environment in which the air-fuel ratio in the combustion chamber 11*b* shifts further towards the lean side than in FIG. 8A.

A value of a vertical axis in the respective FIGS. 8A and 8B indicate a value of a crank angle (also called SA-2%CA) that has passed before 2% of the combustible air-fuel mixture based on mass has burned from the ignition timing. Therefore, as the value of the crank angle increases, the amount of time until combustion of the combustible air-fuel mixture increases. The combustible air-fuel mixture can no longer be combusted within the discharge period, and the likelihood of a misfire becomes high.

As shown in FIG. 8A, in an environment in which the air-fuel mixture in the combustion chamber 11*b* shifts towards the rich side, even when the spark plug 19 generates the discharge spark only once, the combustible air-fuel mixture can be combusted in an amount of time equivalent to that when the spark plug 19 generates the discharge spark twice according to the present embodiment.

However, as shown in FIG. 8B, in an environment in which the air-fuel ratio in the combustion chamber 11*b* shifts towards the lean side, in cases in which the spark plug 19 generates the discharge spark only once, particularly when the discharge spark is that in which the integrated value of the discharge path length L having a large energy density is small, a large amount of time tends to be required until the combustible air-fuel mixture combusts.

That is, even in cases in which the spark plug 19 generates the discharge spark only once, the combustible air-fuel mixture can be favorably combusted when the integrated value of the discharge path length L having a large energy density is large. Conversely, the data suggest that the combustion state of the combustible air-fuel mixture tends to be unfavorable when the integrated value of the discharge path length L having a large energy density is small.

Meanwhile, when the spark plug 19 generates the discharge spark twice according to the present embodiment in an environment in which the air-fuel ratio in the combustion chamber 11*b* shifts towards the lean side, the integrated value of the discharge path length L having a large energy density can be increased compared to that when the discharge spark is generated once. Therefore, the combustion state of the combustible air-fuel mixture can be made favorable within the discharge period. Consequently, as a result of the re-discharge control being performed when the integrated value of the discharge path length L having a large energy density is less than the first threshold by the present combustion state determination control being performed, the combustion state of the combustible air-fuel mixture can be improved.

In addition, when the integrated value of the discharge path length L having a large energy density that has been calculated during the predetermined period is not less than the first threshold, the combustion state of the combustible air-fuel mixture can be estimated to be favorable. Therefore, as a result of the re-discharge control not being performed, the spark plug 19 can be prevented from unnecessarily consuming energy.

A discharge spark of which the energy density D is greater than the predetermined value Th is thought to contribute to the combustion of the combustible air-fuel mixture. However, the combustion state of the combustible air-fuel mixture differs based a total area of the combustible air-fuel mixture facing the discharge spark (a total amount of the combustible air-fuel mixture provided with heat from the discharge spark) (for example, combustion is promoted as the heat that is provided increases). Therefore, as a result of calculation of the integrated value of the discharge path length L having a large energy density, the total area of the combustible air-fuel mixture facing the discharge spark can be ascertained. Moreover, the combustion state of the combustible air-fuel mixture can be estimated.

As indicated in expression (3), the discharge path length L is calculated based on the natural logarithm value of the absolute value of the secondary voltage V2. As a result, a map or the like that prescribes the relationship between the discharge path length L and the secondary voltage V2 in advance is not required to be prepared. The discharge path length L can be calculated by a calculation formula.

The first threshold is set to a greater value as the air-fuel ratio of the combustible air-fuel mixture increases. As a result, the combustion state of the combustible air-fuel mixture can be more accurately estimated.

The first threshold is set to be greater as the amount of EGR gas increases. As a result, the combustion state of the combustible air-fuel mixture can be estimated with higher accuracy.

The predetermined period is set such that the predetermined mask period immediately after the IGBT 312 interrupts conduction of the primary current I1 flowing to the primary coil 311A is excluded. As a result, errors included in the integrated value of the discharge path length L having a large energy density can be reduced.

When the energy density D of the discharge spark is the same, the discharge energy E of the discharge spark increases and the surface area of the discharge spark increases as the discharge path length L increases. In this regard, because the discharge path length L is used as the parameter correlated with the energy of the discharge spark, the state of the discharge spark can be accurately reflected by the parameter. Consequently, through integration of the parameter when the energy density D is greater than the predetermined value Th and comparison between the integrated value and the first threshold, the combustion state of the combustible air-fuel mixture can be estimated with high accuracy In the present combustion state determination control, focus is placed on the energy density D of the discharge spark. The combustion state of the combustible air-fuel mixture is estimated based on the integrated value of the discharge path length L of the discharge spark in a state in which the energy density D is greater than the predetermined value Th. Therefore, even in an environment in which the flow rate of airflow in the combustion chamber 11*b* is high, error in the estimation of the combustion state of the combustible air-fuel mixture can be suppressed.

The above-described embodiment can also be modified in the following manner.

Figure 9:
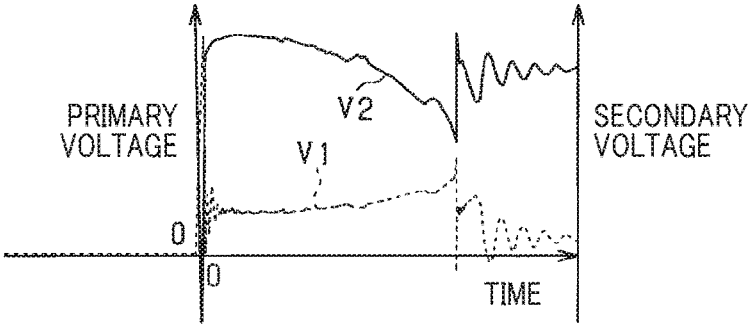
FIG. 9 is a diagram of a relationship between primary voltage and secondary voltage.

According to the above-described embodiment, the secondary voltage V2 applied to the voltage detection path L3 is detected. The discharge energy and the discharge path length L are calculated using the detected secondary voltage V2. Here, the secondary voltage V2 and the primary voltage V1 have opposite signs and differ in magnitude. However, as shown in FIG. 9, because the aspect of changes in the primary voltage V1 tends to be similar to the aspect of changes in the secondary voltage V2, the primary voltage V1 may be used instead of the secondary voltage V2.

Specifically, the ignition circuit unit 31 may be configured to include a voltage detection path that detects the primary voltage V1 applied to the primary coil 311A instead of the voltage detection path L3. The discharge energy and the discharge path length L may be calculated using the detected primary voltage V1. When the discharge energy E is calculated, the calculation is performed based on the product of the absolute value of the primary voltage V1 and the absolute value of the secondary current I2.

According to the above-described embodiment, as indicated in expression (3), the discharge path length L is calculated based on the natural logarithm value of the absolute value of the secondary voltage V2. However, a map that prescribes the relationship between the secondary voltage V2 and the discharge path length L in advance may be provided. The discharge path length L may be estimated with reference to the map, based on the detected secondary voltage V2.

According to the above-described embodiment, the ignition control circuit 314 sets the first threshold. However, the ignition control circuit 314 is not required to set the first threshold. For example, the electronic control unit 32 may set the first threshold.

According to the above-described embodiment, the first threshold serving as the threshold to determine whether or not the combustion state of the combustible air-fuel mixture is favorable is set to a greater value as the air-fuel ratio increases (shifts towards the lean side) or the EGR rate increases. However, the first threshold may be a fixed value.

According to the above-described embodiment, the present combustion state determination control is performed even when the re-discharge control is performed. However, when the re-discharge control is performed, the combustion state of the combustible air-fuel mixture may be considered to have improved and the present combustion state determination control may not be performed. In this case, the execution frequency of the combustion state determination control can be reduced. Load placed on the ignition control circuit 314 can be reduced.

According to the above-described embodiment, the predetermined mask period is set such that the starting point is immediately after the IGBT 312 interrupts conduction of the primary current I1 flowing to the primary coil 311A. However, the mask period may not be set. The predetermined period may be set immediately after the IGBT 312 interrupts conduction of the primary current I1 flowing to the primary coil 311A.

According to the above-described embodiment, the discharge path length L is set as the parameter correlated with the energy of the discharge spark. However, the discharge energy E may be set as the parameter correlated with the energy of the discharge spark.

Figure 10A:
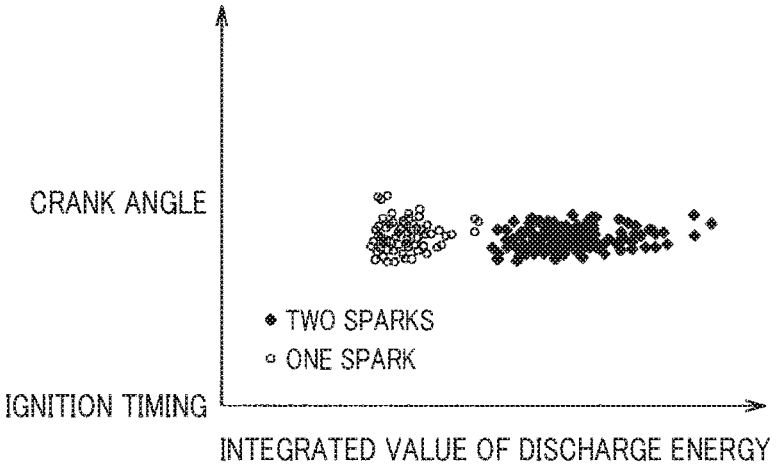
FIGS. 10A and 10B are diagrams of a relationship between an integrated value of discharge energy of a discharge spark having a large energy density and crank angle passed before combustion of 2% of the combustible air-fuel mixture.
Figure 10B:
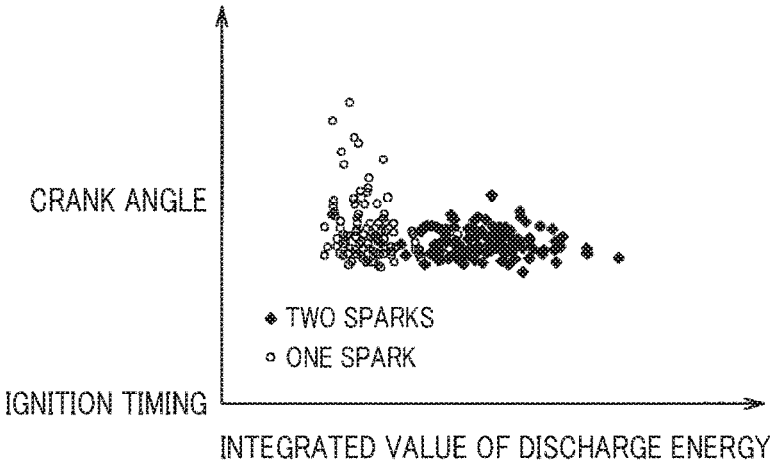

As shown in FIGS. 10A and 10B, the relationship between the integrated value of the discharge energy E of the discharge spark having a large energy density and the value of the crank angle (SA-2%CA) substantially matches the relationship between the integrated value of the discharge path length L having a large energy density and the value of the crank angle (SA-2%CA) shown in FIGS. 8A and 8B.

Therefore, even when the discharge energy E is used as the parameter correlated with the energy of the discharge spark, the combustion state of the combustible air-fuel mixture can be estimated with high accuracy. FIG. 10B shows data obtained in an environment in which the air-fuel ratio in the combustion chamber 11*b* shifts further towards the lean side than that in FIG. 10A.

The ignition circuit unit 31 according to the above-described embodiment is mounted in the engine 11 in which airflow, such as a swirl flow or a tumble flow, is generated in the combustion chamber 11*b* by the airflow control valve 27 provided near the intake port 13, when homogenous lean burn is performed. However, the ignition circuit unit 31 according to the above-described embodiment is not necessarily required to be mounted in the engine 11 that is provided with the airflow control valve 27.

Other Example

According to the above-described embodiment, the content of the step function u in expression (4) is expressed by a difference between the energy density D and the predetermined value Th. Whether or not the energy density D of the discharge spark is greater than the predetermined value Th is determined. However, for example, the content of the step function u may be modified as indicated in expression (5).

$$V=\int L\times u(E-Th\times L)dt \tag{5}$$

Specifically, the product of the predetermined value Th and the discharge path length L may be subtracted from the current discharge energy E of the discharge spark. As a result of the product of the predetermined value Th and the discharge path length L being determined, the discharge energy E of the discharge spark, which has the discharge path length L and the energy density D per unit length being the predetermined value Th, is determined. Therefore, whether or not the energy density D is greater than the predetermined value Th can be determined by the product of the predetermined value Th and the discharge path length L being subtracted from the current discharge energy E of the discharge spark, as well.

Figure 11:
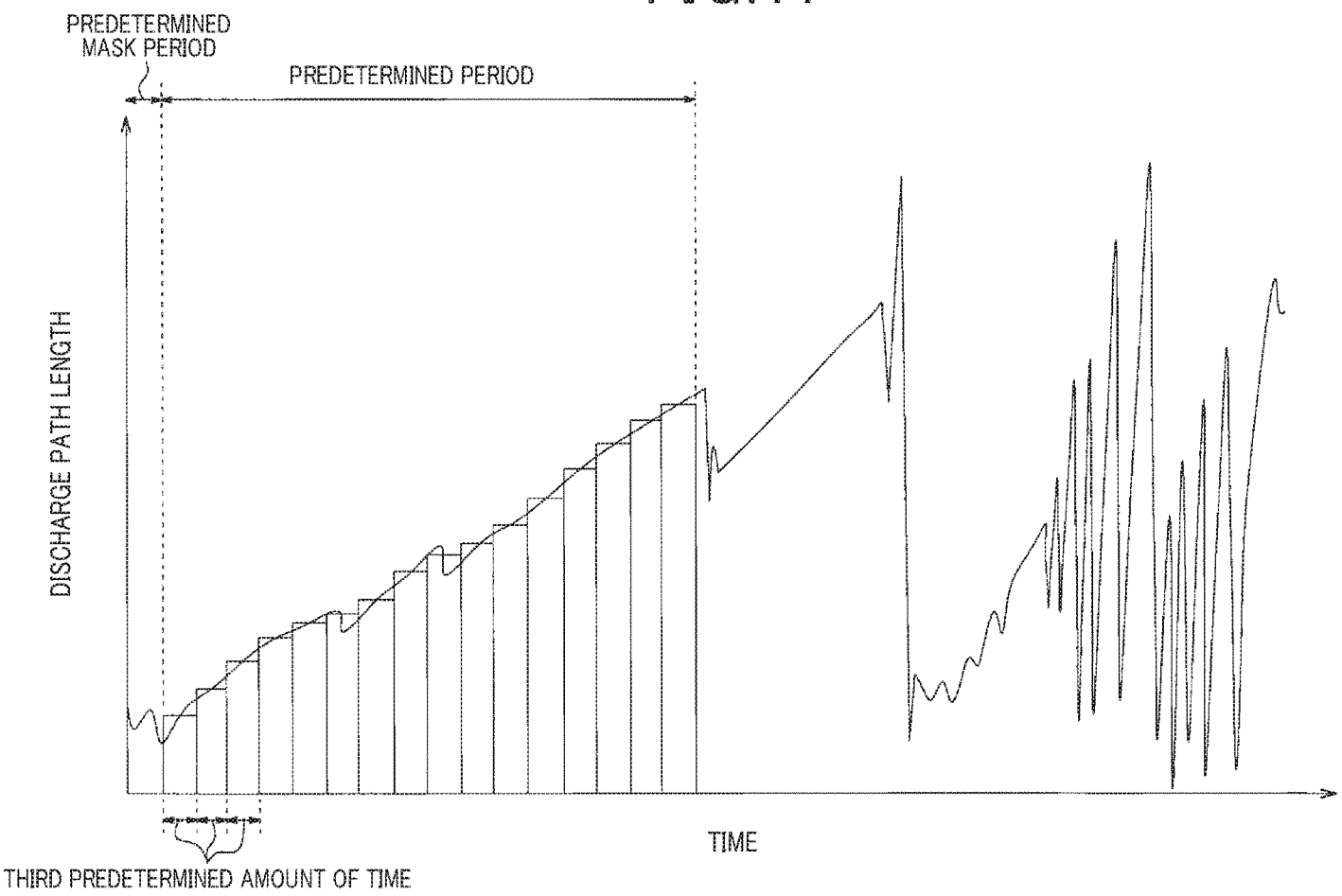
FIG. 11 is a diagram of another method for calculating the integrated value of the discharge path lengths having a large energy density.

According to the above-described embodiment and other example, the discharge path length L is calculated based on expression (4) or expression (5). However, the discharge path length L is not necessarily required to be calculated based on expression (4) or expression (5). For example, as shown in FIG. 11, the discharge path length L of the discharge spark generated by the spark plug 19 may be calculated every time a third predetermined amount of time (such as 0.02 ms) elapses during the predetermined period. All of the discharge path lengths L calculated every time the third predetermined amount of time elapses may be added upon elapse of the predetermined period. The integrated value of the discharge path length L may thereby be calculated. In the graph shown in FIG. 11, the discharge spark during at least the predetermined period is assumed to be in a state in which the energy density D is higher than the first threshold at all times.

The discharge spark generated by the spark plug 19 may be extinguished (discharge ended) before the elapse of the predetermined period, as a result of the discharge spark generated by the spark plug 19 being blown out due to a high flowrate in the cylinders, or carbon produced by incomplete combustion of fuel attaching to outer peripheral portions of the electrodes of the spark plug 19 and flashover discharge occurring between the carbon and an attachment member of the spark plug 19.

In this case, the discharge is assumed to end before the combustible air-fuel mixture is sufficiently heated, and the likelihood of the combustion state of the combustible air-fuel mixture not being favorable is high. As a countermeasure, the re-discharge control is immediately performed when the absolute value of the secondary current I2 flowing to the current detection path L1 becomes less than a second threshold during the predetermined period.

FIG. 12 is a flowchart in which a portion of the flowchart in FIG. 5 has been modified. That is, step S440 is newly added as a step following a NO determination in a determination process at step S380, which corresponds to step S180 in FIG. 5.

At step S440, the ignition control circuit 314 determines whether or not the absolute value of the secondary current I2 detected at step S320, which corresponds to step S120, is less than the second threshold. When determined that the absolute value of the secondary current I2 is not less than the second threshold (NO at S440), the ignition control circuit 314 returns to step S300. When determined that the absolute value of the secondary current I2 is less than the second threshold (YES at S440), the ignition control circuit 314 proceeds to step S430, which corresponds to step S230.

Regarding other steps, processes at steps S300, S310, S330, S340, S350, S360, S370, S390, S400, S410, and S420 in FIG. 12 are respectively identical to the processes at steps S100, S110, S120, S130, S140, S150, S160, S170, S190, S200, S210, and S220 in FIG. 5.

As a result, even should the discharge spark generated by the spark plug 19 be extinguished during the predetermined period, as a result of the re-discharge control being immediately performed, the spark plug 19 can generate the discharge spark again. Furthermore, the interval between the end of discharge and the discharge spark being generated again can be shortened.

Figure 13:
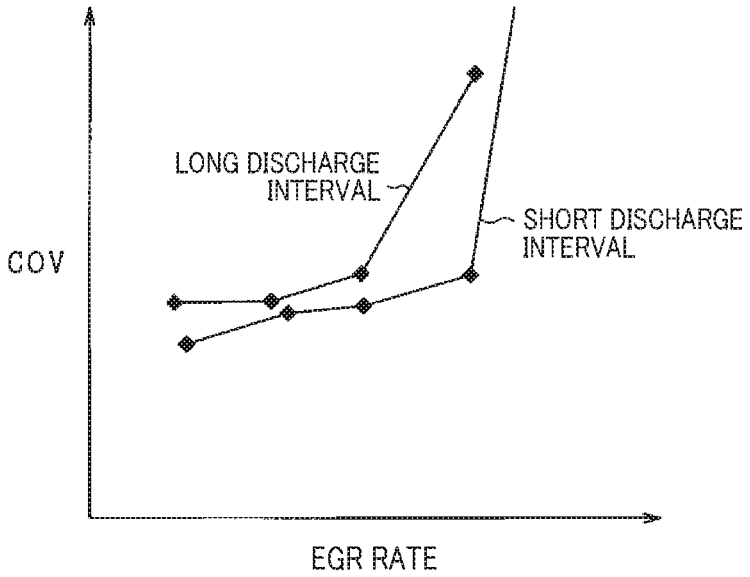
FIG. 13 is a diagram of effects that a discharge interval has on torque variation rate accompanying increase in EGR amount, when discharge is performed twice.

As shown in FIG. 13, as the discharge interval when discharge is performed twice becomes shorter, the torque variation rate (expressed by coefficient of variance (VCO) in FIG. 3) can be reduced even in an environment in which the EGR rate is high. A reason for this is thought to be that, because the combustible air-fuel mixture that has been heated by the initially generated discharge spark is reheated by the discharge spark generated the second time by the re-discharge control, deterioration of ignitability and combustion state of the combustible air-fuel mixture can be suppressed.

In this example, when the absolute value of the secondary current I2 flowing to the current detection path L1 becomes less than the second threshold during the predetermined period, the re-discharge control is immediately performed. However, the determination may be made based on the absolute value of the primary voltage V1 or the absolute value of the secondary voltage V2 instead of the absolute value of the secondary current I2. Specifically, a configuration is possible in which the re-discharge control is immediately performed when the absolute value of the primary voltage V1 or the absolute value of the secondary voltage V2 becomes less than a third threshold provided to identify zero, during the predetermined period.

In this example, the re-discharge control is immediately performed when the absolute value of the secondary current I2 flowing to the current detection path L1 becomes less than the second threshold during the predetermined period. However, the determination may be performed based on the discharge energy E instead of the absolute value of the secondary current I2. Specifically, a configuration is possible in which the re-discharge control is immediately performed when the discharge energy E becomes less than a fourth threshold.

The relationships among the predetermined value Th and the first to fourth thresholds are as follows.

(i) The predetermined value Th is a threshold for determining whether or not the discharge spark generated by the spark plug 19 contributes to combustion of the combustible air-fuel mixture.

(ii) The first threshold is a threshold (i.e., a predetermined determination threshold corresponding to a first determination threshold) for determining that the discharge spark sufficiently contributes to the combustion of the combustible air-fuel mixture, and therefore, the combustion state of the air-fuel mixture is favorable, based on the discharge path length L.

(iii) The second threshold is a threshold for determining whether or not the discharge spark generated by the spark plug 19 has been extinguished during the predetermined period based on the absolute value of the secondary current I2.

(iv) The third threshold is a threshold for determining whether or not the discharge spark generated by the spark plug 19 has been extinguished during the predetermined period based on the absolute value of the primary voltage V1 or the absolute value of the secondary voltage V2.

(v) The fourth threshold is a threshold for determining whether or not the discharge spark generated by the spark plug 19 has been extinguished during the predetermined period based on the discharge energy E. At this time, when the discharge spark generated by the spark plug 19 is determined to have been extinguished during the predetermined period, the re-discharge control is immediately performed.

The second to fourth thresholds can also be considered to be thresholds for determining whether or not the re-discharge control is to be immediately performed. Therefore, the second to fourth thresholds all correspond to a second determination threshold that is different from the first determination threshold.

What is claimed is:

1. An ignition control system for an internal combustion engine including a spark plug that generates a discharge spark between a pair of discharge electrodes for igniting a combustible air-fuel mixture in a cylinder of the internal combustion engine, an ignition coil that includes a primary coil and a secondary coil and applies a secondary voltage to the spark plug by the secondary coil, a voltage value detecting unit that detects a voltage value of at least either of a primary voltage applied to the primary coil and the secondary voltage applied to the spark plug, and a secondary current detecting unit that detects a secondary current flowing to the spark plug, the ignition control system comprising:

a primary current control unit that performs discharge generation control one or more times during a single combustion cycle, the discharge generation control allowing the spark plug to generate the discharge spark by a primary current to the primary coil being interrupted after conduction of the primary current to the primary coil;

a parameter calculating unit that successively calculates a parameter correlated with energy of the discharge spark based on the voltage value detected by the voltage value detecting unit;

an energy density calculating unit that successively calculates energy density that is energy per unit length of the discharge spark; and an integrated value calculating unit that when the energy density calculated by the energy density calculating unit is greater than a predetermined value during a predetermined period after the primary current is interrupted during the single combustion cycle, calculates an integrated value by integrating the parameter calculated by the parameter calculating unit during the predetermined period, wherein the primary current control unit performs the discharge generation control again when the integrated value calculated by the integrated value calculating unit is less than a predetermined determination threshold.

2. The ignition control system according to claim 1, further comprising:

a discharge path length calculating unit that successively calculates a discharge path length that is a length of the discharge spark formed between the discharge electrodes, based on the voltage value detected by the voltage value detecting unit; and a discharge energy calculating unit that successively calculates, as discharge energy, a product of an absolute value of the voltage value detected by the voltage value detecting unit and an absolute value of the secondary current detected by the secondary current detecting unit, wherein the energy density calculating unit successively calculates the energy density by dividing the discharge energy calculated by the discharge energy calculating unit by the discharge path length calculated by the discharge path length calculating unit.

3. The ignition control system according to claim 2, wherein:

the discharge path length calculating unit calculates the discharge path length based on a natural logarithm value of the absolute value of the voltage value detected by the voltage value detecting unit.

4. The ignition control system according to claim 3, wherein:

the predetermined determination threshold is set to a greater value as an air-fuel ratio of the combustible air-fuel mixture increases.

5. The ignition control system according to claim 4, wherein:

the internal combustion engine includes an exhaust gas recirculation mechanism that recirculates exhaust gas produced by combustion of the combustible air-fuel mixture back to the cylinder; and the predetermined determination threshold is set to a greater value as a recirculation amount of the exhaust gas increases.

6. The ignition control system according to claim 5, wherein:

the integrated value calculating unit calculates the integrated value during the predetermined period when the primary current control unit performs the discharge generation control again; and the primary current control unit performs the discharge generation control again when a total value of an integrated value integrated by the integrated value calculating unit up to a current point and an integrated value that is currently calculated is less than the predetermined determination threshold during the single combustion cycle.

7. The ignition control system according to claim 6, further comprising:

a discharge energy calculating unit that successively calculates, as discharge energy, a product of an absolute value of the voltage value detected by the voltage value detecting unit and an absolute value of the secondary current detected by the secondary current detecting unit as the discharge energy, wherein the predetermined determination threshold is a first determination threshold, the primary current control unit immediately performs the discharge generation control again, when at least one of values is less than a second determination threshold during the predetermined period, the values including: (i) the absolute value of the voltage value detected by the voltage value detecting unit; (ii) the absolute value of the secondary current detected by the secondary current detecting unit; and (iii) the discharge energy calculated by the discharge energy calculating unit, the second determination threshold being different from the first determination threshold.

8. The ignition control system according to claim 7, wherein:

the predetermined period is set such that a predetermined mask period immediately after interruption of the primary current is excluded.

9. The ignition control system according to claim 2, wherein:

the parameter is the discharge length calculated by the discharge path length calculating unit.

10. The ignition control system according to claim 8, wherein:

the internal combustion engine includes an airflow generating unit that generates an air flow in the cylinder; and the airflow generating unit generates the airflow in the cylinder when a lean air-fuel mixture that is homogenous and lean is generated in the cylinder and homogenous lean burn is performed.

11. The ignition control system according to claim 1, wherein:

the predetermined determination threshold is set to a greater value as an air-fuel ratio of the combustible air-fuel mixture increases.

12. The ignition control system according to claim 1, wherein:

the internal combustion engine includes an exhaust gas recirculation mechanism that recirculates exhaust gas produced by combustion of the combustible air-fuel mixture back to the cylinder; and the predetermined determination threshold is set to a greater value as a recirculation amount of the exhaust gas increases.

13. The ignition control system according to claim 1, wherein:

the integrated value calculating unit calculates the integrated value during the predetermined period when the primary current control unit performs the discharge generation control again; and the primary current control unit performs the discharge generation control again when a total value of an integrated value integrated by the integrated value calculating unit up to a current point and an integrated value that is currently calculated is less than the predetermined determination threshold during the single combustion cycle.

14. The ignition control system according to claim 1, further comprising:

a discharge energy calculating unit that successively calculates, as discharge energy, a product of an absolute value of the voltage value detected by the voltage value detecting unit and an absolute value of the secondary current detected by the secondary current detecting unit as the discharge energy, wherein the predetermined determination threshold is a first determination threshold, the primary current control unit immediately performs the discharge generation control again, when at least one of values is less than a second determination threshold during the predetermined period, the values including: (i) the absolute value of the voltage value detected by the voltage value detecting unit; (ii) the absolute value of the secondary current detected by the secondary current detecting unit; and (iii) the discharge energy calculated by the discharge energy calculating unit, the second determination threshold being different from the first determination threshold.

15. The ignition control system according to claim 1, wherein:

the predetermined period is set such that a predetermined mask period immediately after interruption of the primary current is excluded.

16. The ignition control system according to claim 3, wherein:

the parameter is the discharge length calculated by the discharge path length calculating unit.

17. The ignition control system according to claim 1, wherein:

the internal combustion engine includes an airflow generating unit that generates an air flow in the cylinder; and the airflow generating unit generates the airflow in the cylinder when a lean air-fuel mixture that is homogenous and lean is generated in the cylinder and homogenous lean burn is performed.

18. An ignition control method for an internal combustion engine including a spark plug that generates a discharge spark between a pair of discharge electrodes for igniting a combustible air-fuel mixture in a cylinder of the internal combustion engine, an ignition coil that includes a primary coil and a secondary coil and applies a secondary voltage to the spark plug by the secondary coil, a voltage value detecting unit that detects a voltage value of at least either of a primary voltage applied to the primary coil and the secondary voltage applied to the spark plug, and a secondary current detecting unit that detects a secondary current flowing to the spark plug, the ignition control method comprising:

performing discharge generation control one or more times during a single combustion cycle, the discharge generation control allowing the spark plug to generate the discharge spark by a primary current to the primary coil being interrupted after conduction of the primary current to the primary coil;

successively calculating a parameter correlated with energy of the discharge spark based on the detected voltage value;

successively calculating energy density that is energy per unit length of the discharge spark;

when the calculated energy density is greater than a predetermined value during a predetermined period after the primary current is interrupted during the single combustion cycle, calculating an integrated value by integrating the calculated parameter during the predetermined period; and performing the discharge generation control again when the calculated integrated value is less than a predetermined determination threshold.

* * * * *